US010434554B2

(12) United States Patent
Rowland

(10) Patent No.: US 10,434,554 B2
(45) Date of Patent: Oct. 8, 2019

(54) METHOD OF MANUFACTURING A COILED TUBING STRING

(71) Applicant: FORUM US, INC., Houston, TX (US)

(72) Inventor: Raymond Rowland, Dayton, TX (US)

(73) Assignee: FORUM US, INC., Houston, TX (US)

( * ) Notice: Subject to any disclaimer, the term of this patent is extended or adjusted under 35 U.S.C. 154(b) by 27 days.

(21) Appl. No.: 15/407,855

(22) Filed: Jan. 17, 2017

(65) Prior Publication Data

US 2018/0200770 A1 Jul. 19, 2018

(51) Int. Cl.

| | |
|---|---|
| ***B21C 37/08*** | (2006.01) |
| ***B21C 37/30*** | (2006.01) |
| ***C21D 9/08*** | (2006.01) |
| ***C21D 9/50*** | (2006.01) |
| ***E21B 17/20*** | (2006.01) |
| ***C21D 8/10*** | (2006.01) |

(52) U.S. Cl.

CPC ..... *B21C 37/08* (2013.01); *B21C 37/30* (2013.01); *C21D 8/105* (2013.01); *C21D 9/08* (2013.01); *C21D 9/50* (2013.01); *E21B 17/20* (2013.01)

(58) Field of Classification Search

CPC ..... B21C 37/06; B21C 37/08; B21C 37/30; C21D 9/08; C21D 9/085; C21D 9/50

See application file for complete search history.

(56) References Cited

U.S. PATENT DOCUMENTS

| | | | |
|---|---|---|---|
| 2,982,312 | A | 5/1961 | Isadore Caplan et al. |
| 4,863,091 | A | 9/1989 | Dubois |
| 5,515,707 | A | 5/1996 | Smith |
| 9,528,327 | B1 | 12/2016 | Lux |
| 9,541,224 | B2 | 1/2017 | Rowland et al. |
| 2014/0021244 | A1 | 1/2014 | DuBois |

OTHER PUBLICATIONS

International Search and Written Opinion dated Apr. 4, 2018, corresponding to Application No. PCT/US2018/013988.

*Primary Examiner* — Teresa M Ekiert

(74) *Attorney, Agent, or Firm* — Patterson + Sheridan, LLP

(57) ABSTRACT

A method of manufacturing a coiled tubing string including uncoiling a flat metal sheet from an accumulator; bending the flat metal sheet that is uncoiled from the accumulator into a tubular form such that the edges of the flat metal sheet form a seam along a longitudinal length of the tubular form; welding the seam formed along the longitudinal length to form a tubing string; and coiling the tubing string onto a spool, wherein the tubing string is heat treated to meet specified material properties in a continuous operation from the accumulator to the spool.

15 Claims, 2 Drawing Sheets

METHOD OF MANUFACTURING A COILED TUBING STRING

BACKGROUND

Field

The disclosure relates to a method of manufacturing a coiled tubing string.

Description of the Related Art

Coiled tubing strings are used in many applications in the oil and gas industry. The tubing string is formed from flat metal strips that are joined end to end into a flat metal sheet and coiled onto an accumulator. The flat metal sheet is generally uncoiled from the accumulator, bent into tubular form, and welded along the seam to produce a string of tubing. The tubing string is then coiled onto a spool.

Typically, the coiled tubing string is moved to another location and uncoiled from the spool for additional treatment, such as heating, quenching, and tempering to attain specified material properties. Subsequent to the additional treatment, the tubing string is re-coiled onto another spool and transported to another location for additional testing before use in an oil and gas operation. The uncoiling, moving, and re-coiling of the tubing string adds time and expense to the process of manufacturing the tubing string.

Therefore, there is a need for an improved method of manufacturing a coiled tubing string.

SUMMARY

In one embodiment, a method of manufacturing a coiled tubing string comprises uncoiling a flat metal sheet from an accumulator; bending the flat metal sheet that is uncoiled from the accumulator into a tubular form such that the edges of the flat metal sheet form a seam along a longitudinal length of the tubular form; welding the seam formed along the longitudinal length to form a tubing string; and coiling the tubing string onto a spool, wherein the tubing string is heat treated to meet specified material properties in a continuous operation from the accumulator to the spool.

BRIEF DESCRIPTION OF THE DRAWINGS

So that the manner in which the above recited features of the disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

DETAILED DESCRIPTION

Figure 1:
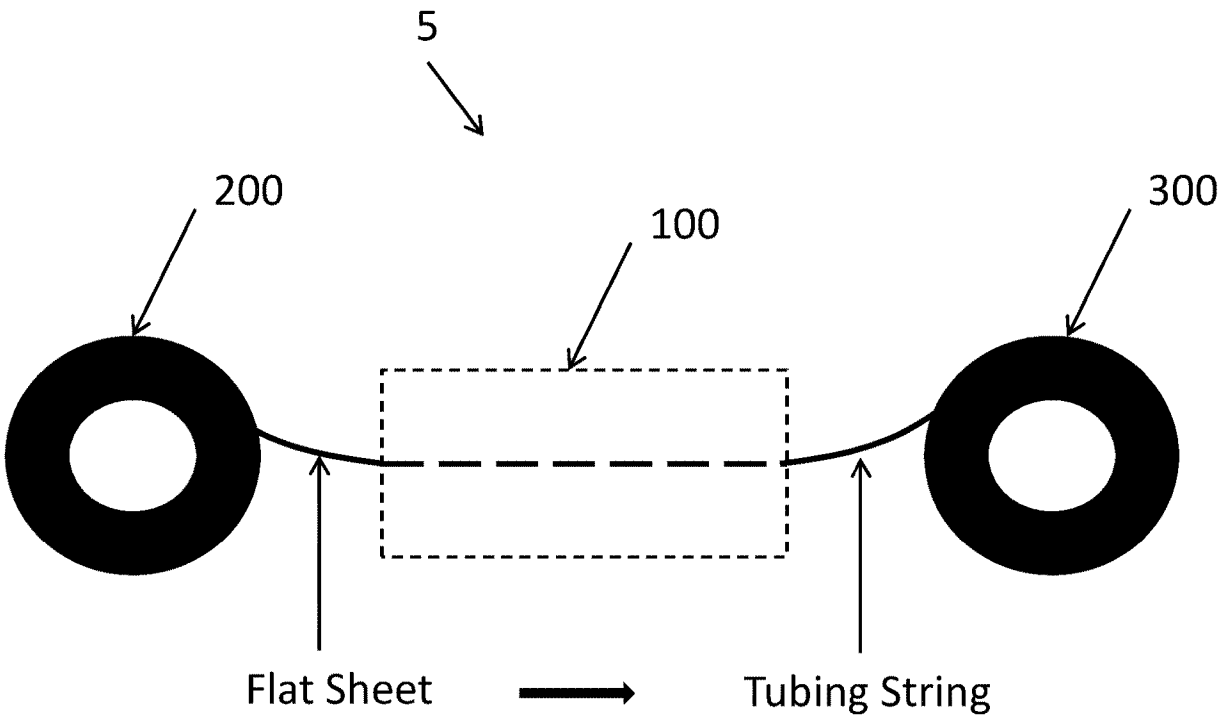
FIG. 1 is a schematic illustration of a coiled tubing string operation, according to one embodiment.

FIG. 1 is a schematic illustration of a coiled tubing string operation 5, according to one embodiment. The operation 5 includes uncoiling a flat sheet of metal from an accumulator 200, feeding the flat sheet through a method 100 of manufacturing a coiled tubing string, and coiling the formed tubing string onto a spool 300, all in a single continuous operation to meet specified material properties. Although additional testing, inspection, and installation may occur after the tubing string is spooled onto the spool 300, the tubing string will be manufactured to meet specified material properties upon being coiled onto the spool 300.

The specified material properties may include, but are not limited to, physical properties, mechanical properties, and structural properties. The physical properties may include, but are not limited to, dimensions (such as length, inner/outer diameter size, and wall thickness), surface quality (such as smoothness), and roundness. The mechanical properties may include but are not limited to, yield strength, tensile strength, elongation, elastic modulus, toughness, fracture toughness, hardness, fatigue life, fatigue strength, ductility. The structural properties may include, but are not limited to grain size, corrosion resistance, microstructure, and composition.

The operation 5 has an increased output and is more efficient than other coiled tubing string heat treatment operations, which require uncoiling, re-coiling, and moving of the tubing string multiple times and to multiple locations for additional treatments, such as heat treatments, to meet specified material properties. The tubing string formed according to the method 100 described herein is fully formed and treated in a complete, continuous operation, starting from the uncoiling of the flat sheet of metal from the accumulator 200, and ending with the coiling of the tubing string onto the spool 300, fully meeting specified material properties. The tubing string formed according to the method 100 described herein does not require uncoiling, re-straightening, or moving of the tubing string from the spool 300 for additional treatments to meet specified material properties. The speed at which the tubing string is formed, treated, and/or coiled can be controlled, e.g. increased or decreased, throughout the entire operation 5.

Figure 2:
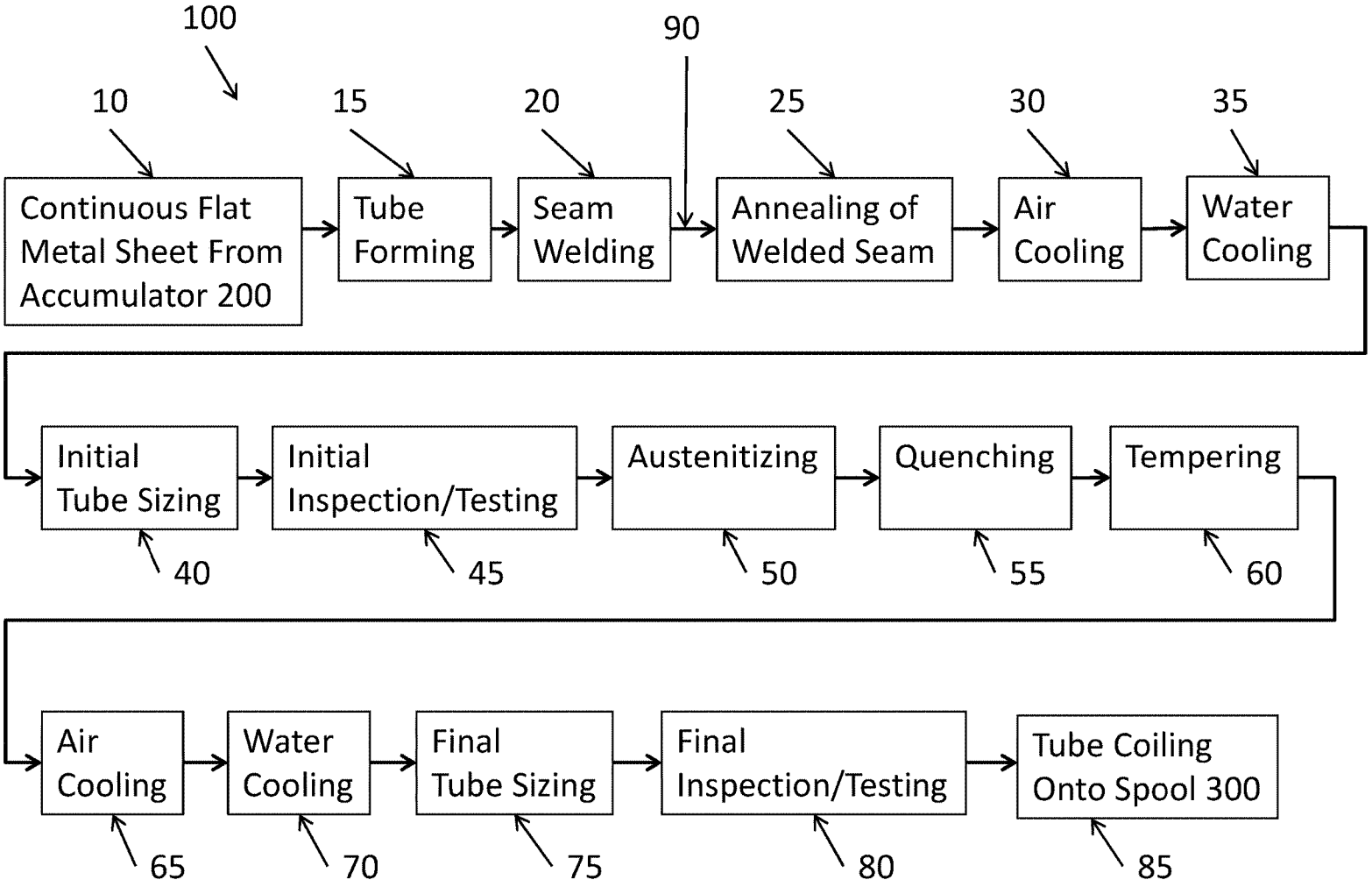
FIG. 2 is a schematic illustration of a method of manufacturing a coiled tubing string, according to one embodiment.

FIG. 2 schematically illustrates the method 100 of manufacturing a coiled tubing string in a continuous operation, beginning with a continuous flat metal sheet 10 and ending with a tubing string coiled onto a spool 300 (shown in FIG. 1). The flat metal sheet 10 may be pre-coiled onto the accumulator 200. The flat metal sheet 10 may comprise wrought iron or steel.

The flat metal sheet 10 is continuously fed from the accumulator 200 into the tube forming operation 15. In the tube forming operation 15, the flat metal sheet 10 is bent into a tubular form such that a longitudinal seam is formed along the longitudinal length by the edges of the flat metal sheet 10 that are brought together. The flat metal sheet 10 may be bent into the tubular form using one or more tube formers as known in the art.

From the tube forming operation 15, the flat metal sheet 10 is continuously fed into a seam welding operation 20. In the seam welding operation 20, the flat metal sheet 10 that has been bent into a tubular form is welded along the seam to form a tubing string 90. The seam may be welded using a high frequency induction welding process and/or other welding processes as known in the art.

After the seam welding operation 20, the tubing string 90 is sent through a seam annealing operation 25, an air cooling operation 30, and/or a water cooling operation 35, collectively referred to as an initial cooling operation. In particular, the tubing string 90 is annealed along the seam weld, then air cooled, and/or then water cooled to ambient temperature.

In the seam annealing operation 25, for example, the welded seam is quickly heated (such as by induction heating to a temperature of about 955 degrees Celsius) to reduce hardness, refine grain size, and increase ductility of the welded seam. In the air cooling operation 30 and/or the water cooling operation 35, for example, the tubing string 90 is slowly cooled entirely or at least partially by air and/or water to bring down the temperature of the tubing string 90 to ambient temperature for initial tube sizing and/or inspection/testing operations. The initial cooling operation may include any number of air cooling and/or water cooling operations.

After the initial cooling operation, an initial tube sizing operation 40 is conducted. The tubing string 90 progresses through the initial tube sizing operation 40 where one or more sizing rollers form the preliminary outside diameter of the tubing string 90. For example, the one or more rollers (incrementally) reduce the outer diameter of the tubing string 90 from a larger outer diameter to a smaller nominal outer diameter. After the initial tube sizing operation 40, the tubing string 90 undergoes an initial inspection/testing operation 45 where one or more non-destructive tests are conducted on the tubing string 90 to verify that the specified material properties and weld seam quality of the tubing string 90 have been attained.

From the initial inspection/testing operation 45, the tubing string 90 is sent through an austenitizing operation 50, a quenching operation 55, and/or a tempering operation 60, collectively referred to as a heat treatment operation. In particular, the tubing string 90 is treated, e.g. repeatedly heated and/or cooled, by the heat treatment operation to attain specified material properties, such as by changing the microstructure of the tubing string 90.

In the austenitizing operation 50, for example, the tubing string 90 is heated to a temperature within a range of about 850 degrees Celsius to about 1,050 degrees Celsius to change the microstructure of the tubing string 90 to austenite. In the quenching operation 55, for example, the tubing string 90 is rapidly cooled by water to form martensite and increase the hardness and strength of the tubing string 90. In the tempering operation 60, for example, the tubing string 90 is heated again to decrease some of the hardness of the tubing string 90 attained during the quenching operation 55 and form a tempered martensite microstructure. The heat treatment operation may include any number of austenitizing, quenching, and/or tempering operations.

After the heat treatment operations, the tubing string 90 is sent through another air cooling operation 65 and/or another water cooling operation 70, collectively referred to as a final cooling operation. In particular, the tubing string 90 is air cooled and then water cooled to ambient temperature. In the air cooling operation 65 and/or the water cooling operation 70, for example, the tubing string 90 is slowly cooled by air and/or water to bring down the temperature of the tubing string 90 for final tube sizing, inspection/testing, and/or coiling operations. The final cooling operation may include any number of air cooling and/or water cooling operations.

From the final cooling operation, the tubing string 90 is continuously fed into a final tube sizing operation 75 to conduct final tube sizing. In the final tube sizing operation 75, the outer diameter of the tubing string 90 is refined to a desired outer diameter. For example, the outer diameter of the tubing string 90 may be reduced (in one or more stages by one or more series of sizing rollers) during the final tube sizing operation 75. The tubing string 90 may be sized to have a substantially uniform outer diameter, a substantially uniform inner diameter, and/or a substantially uniform wall thickness. After the final tube sizing operation 75, the tubing string 90 undergoes a final inspection/testing operation 80 where one or more non-destructive tests are conducted on the tubing string 90 to verify that the specified material properties and weld seam quality of the tubing string 90 have been attained.

From the final inspection/testing operation 80, the tubing string 90 is continuously fed into a tube coiling operation 85. In the tube coiling operation 85, the tubing string 90 is continuously coiled onto a spool, such as the spool 300 illustrated in FIG. 1. The tubing string 90 has met all specified material properties and weld seam quality upon being coiled onto the spool 300.

The method 100 is not limited to the sequence or number of operations illustrated in FIG. 2, but may include other embodiments that include re-ordering, repeating, adding, and/or removing one or more of the operations 15, 20, 25, 30, 35, 40, 45, 50, 55, 60, 65, 70, 75, 80, and/or 85.

The specified material properties of the tubing string 90 formed by the method 100 may be substantially uniform across substantially the entire length of the tubing string 90 but may vary within normal tolerance ranges.

In one embodiment, a tubing string having a length within a range of about 10,000 feet to about 30,000 feet may be formed using the method 100 described herein. In one embodiment, a tubing string having an outer diameter within a range of about 1.5 inches to about 5.5 inches may be formed using the method 100 described herein. In one embodiment, a tubing string having an inner diameter within a range of about 1 inch to about 5 inches may be formed using the method 100 described herein. In one embodiment, a tubing string having at least one of an outer diameter and an inner diameter within a range of about 1 inch to about 5.5 inches may be formed using the method 100 described herein.

In one embodiment, a tubing string having a yield strength within a range of about 80,000 psi to about 165,000 psi may be formed using the method 100 described herein. In one embodiment, a tubing string having a tensile strength within a range of about 90,000 psi to about 190,000 psi may be formed using the method 100 described herein. In one embodiment, a tubing string having a hardness within a range of about 18 Rockwell HRC to about 40 Rockwell HRC may be formed using the method 100 described herein.

It will be appreciated to those skilled in the art that the preceding embodiments are exemplary and not limiting. It is intended that all modifications, permutations, enhancements, equivalents, and improvements thereto that are apparent to those skilled in the art upon a reading of the specification and a study of the drawings are included within scope of the disclosure. It is therefore intended that the following appended claims may include all such modifications, permutations, enhancements, equivalents, and improvements.

I claim:

1. A method of manufacturing a coiled tubing string, comprising:

uncoiling a flat metal sheet from an accumulator;

bending the flat metal sheet that is uncoiled from the accumulator into a tubular form such that the edges of the flat metal sheet form a seam along a longitudinal length of the tubular form;

welding the seam formed along the longitudinal length to form a tubing string;

heat treating the welded seam at a first temperature;

cooling the tubing string in an initial cooling operation after heat treating the welded the seam;

conducting an initial sizing operation to reduce the outer diameter of the tubing string after the initial cooling operation;

heat treating the tubing string at a second temperature in a heat treatment operation after the initial sizing operation to meet specified material properties;

cooling the tubing string in a final cooling operation after the heat treatment operation;

conducting a final sizing operation to further reduce the outer diameter of the tubing string after the final cooling operation; and coiling the tubing string onto a spool after the final sizing operation in a continuous operation from the accumulator to the spool.

2. The method of claim 1, wherein the seam is welded together by induction welding and/or other welding processes.

3. The method of claim 1, wherein the initial cooling operation comprises air cooling the tubing string after heat treating the welded seam.

4. The method of claim 1, wherein the initial cooling operation comprises water cooling the tubing string after heat treating the welded seam.

5. The method of claim 1, further comprising conducting an initial inspection and testing operation of the tubing string after the initial sizing operation.

6. The method of claim 1, wherein the heat treatment operation comprises austenitizing the tubing string.

7. The method of claim 1, wherein the heat treatment operation comprises quenching the tubing string.

8. The method of claim 1, wherein the heat treatment operation comprises tempering the tubing string.

9. The method of claim 1, wherein the final cooling operation comprises air cooling the tubing string.

10. The method of claim 1, wherein the final cooling operation comprises water cooling the tubing string.

11. The method of claim 1, further comprising conducting a final inspection and testing operation of the tubing string after the final sizing operation.

12. The method of claim 11, wherein the coiling of the tubing string onto the spool is conducted after conducting the final inspection and testing operation of the tubing string.

13. The method of claim 1, wherein the specified material properties include at least one of dimension, surface quality, roundness, yield strength, tensile strength, elongation, elastic modulus, toughness, fracture toughness, hardness, fatigue life, fatigue strength, ductility, grain size, corrosion resistance, microstructure, and composition.

14. The method of claim 1, wherein the specified material properties of the tubing string coiled onto the spool are substantially uniform across substantially the entire length of the tubing string.

15. The method of claim 1, wherein a length of the tubing string coiled onto the spool is within a range of 10,000 feet to 30,000 feet.

* * * * *